US006409364B1

(12) United States Patent
Lin

(10) Patent No.: US 6,409,364 B1
(45) Date of Patent: Jun. 25, 2002

(54) FASTENING DEVICE FOR CHRISTMAS LIGHT

(76) Inventor: Mei-Lu Lin, P.O. Box 697, Feng-Yuan City 420 (TW)

( * ) Notice: Subject to any disclaimer, the term of this patent is extended or adjusted under 35 U.S.C. 154(b) by 50 days.

(21) Appl. No.: 09/595,393

(22) Filed: Jun. 14, 2000

(51) Int. Cl.[7] ..... F21V 21/00

(52) U.S. Cl. ..... 362/391; 362/226; 362/249; 362/396; 362/806

(58) Field of Search ..... 362/123, 226, 362/249, 391, 396, 806

(56) References Cited

U.S. PATENT DOCUMENTS 4,660,919 A * 4/1987 Levy ..... 439/418
5,580,159 A * 12/1996 Liu ..... 362/249
5,788,362 A * 8/1998 Chou ..... 362/249
6,079,848 A * 6/2000 Ahroni ..... 362/249
6,142,429 A * 11/2000 Ahroni ..... 362/249

* cited by examiner

*Primary Examiner*—Sandra O'Shea
*Assistant Examiner*—Peggy A Nells

(57) ABSTRACT

A fastening device for a Christmas light which includes a socket of a conventional type having a notch in a circumferential wall of the bottom. A cap engaged with the bottom of the socket having a narrow portion on the root of a projection facing to the notch of the socket. A separating fastener of L-shaped section having a jaw engageable with the narrow portion of the projection through the notch, a first clip defined between the socket and the lower portion of the fastener and a second clip defined by an extension and the outer surface of the first clip. Both the first and second clips have a serrated portion on their inner surfaces in order to firmly attach the Christmas light to a flat or linear object.

2 Claims, 5 Drawing Sheets

FASTENING DEVICE FOR CHRISTMAS LIGHT

BACKGROUND OF THE INVENTION

The present invention relates to the Christmas light and more particularly to a fastening device for Christmas light which device can selectively attach the Christmas light to a flat or linear object.

A typical Christmas light 1 (as shown in FIGS. 1 and 2) comprises a socket 2, and bulb 3 engaging with a capper base 5 screwed into the socket 2, a pair electrical wires 4 extending through the bottom of the socket 2 and a separating fastener which has a hoop 6 disposed between the base 5 and socket 2 and a rod 7 perpendicular to an outer periphery of the hoop 6 for attaching the Christmas light into a narrow opening of an object. This type of the fastener has a disadvantage that the hoop 6 under frequent vibrations may disengage the base 5 with the socket or causes a power failure.

FIG. 3 shows another typical Christmas light 10 which includes a different type of the fastener 13 integral with a cap of the socket 12. The fastener 13 can hook or clip the Christmas light to a flat or linear object and is more durable than the fastener discussed the above. However, it occupies a great deal of space that is not economical for packing for transportation.

SUMMARY OF THE PRESENT INVENTION

The present invention has a main object to provide a fastening device for Christmas lights including a separating fastener which can be selectively used by the user to attach some of the Christmas lights to a flat or linear object.

Another object of the present invention is to provide a fastening device for Christmas light which saves space to pack for transportation.

The present invention will become more fully understood by reference to the following detailed description thereof when read in conjunction with the attached drawings.

DETAILED DESCRIPTION OF THE PREFERRED EMBODIMENT

Figure 1:
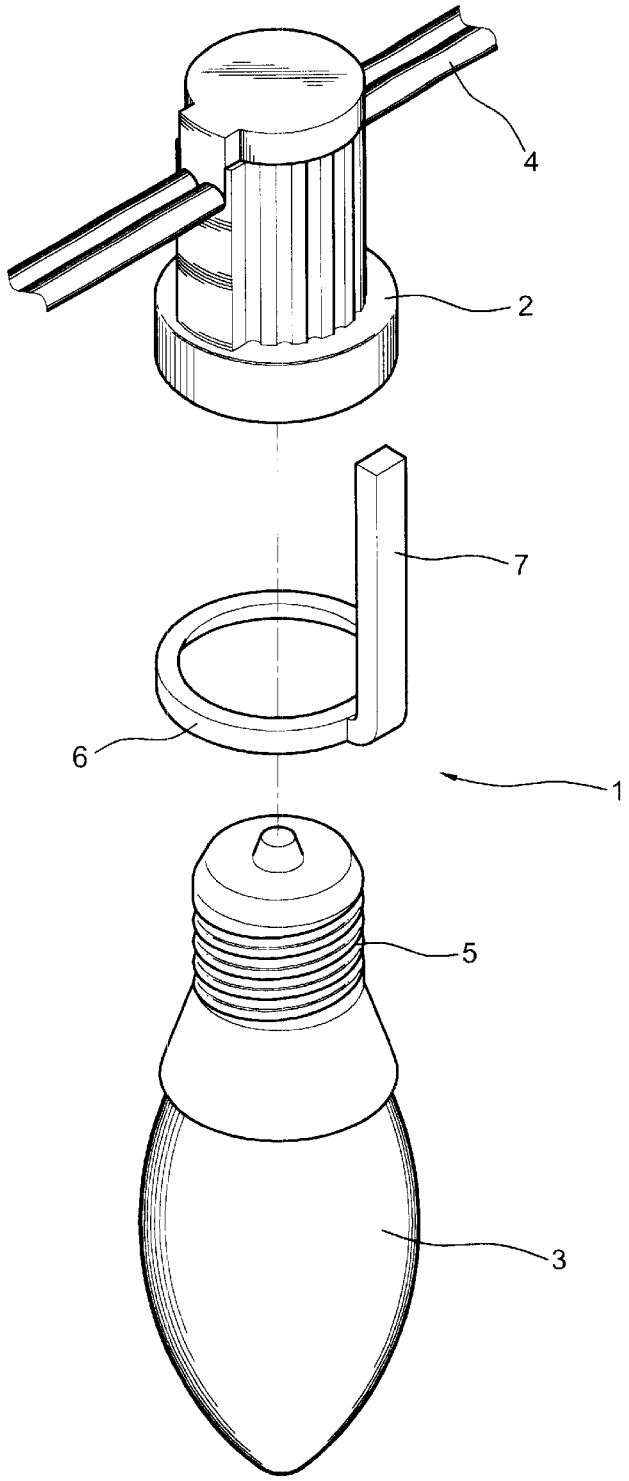
FIG. 1 Prior Art
FIG. 1 is an exploded perspective view to show a Christmas light of a prior art having a separating fastener.
Figure 3:
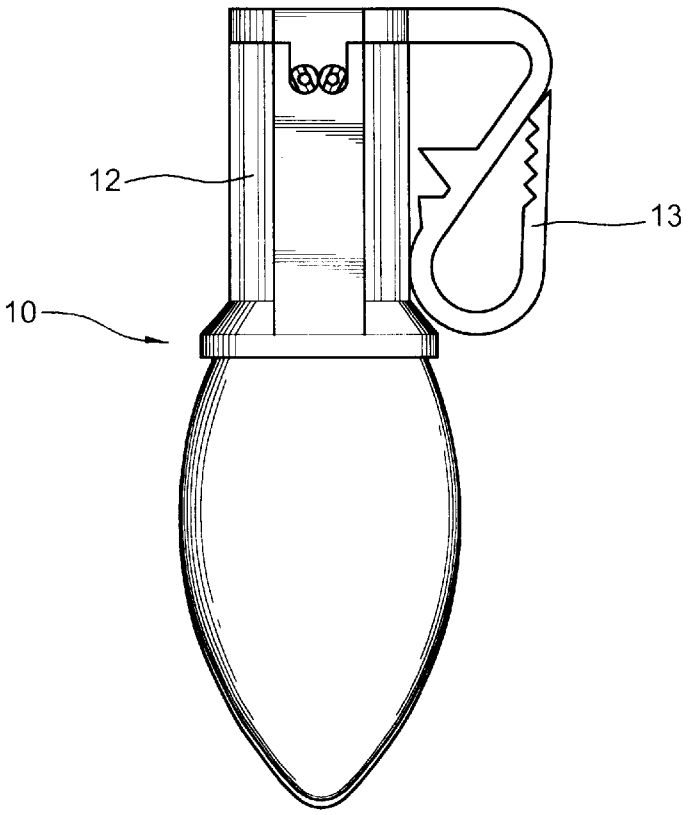
FIG.3 Prior Art
FIG. 3 is a sectional view to show a Christmas light of a prior art having an integrated fastener.
Figure 2:
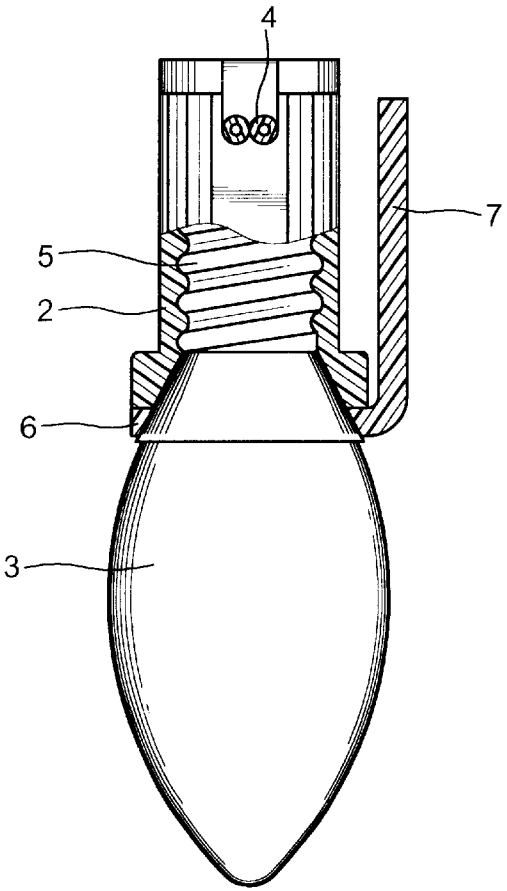
FIG.2 Prior Art
FIG. 2 is a sectional view of the assembly of FIG. 1.
Figure 4:
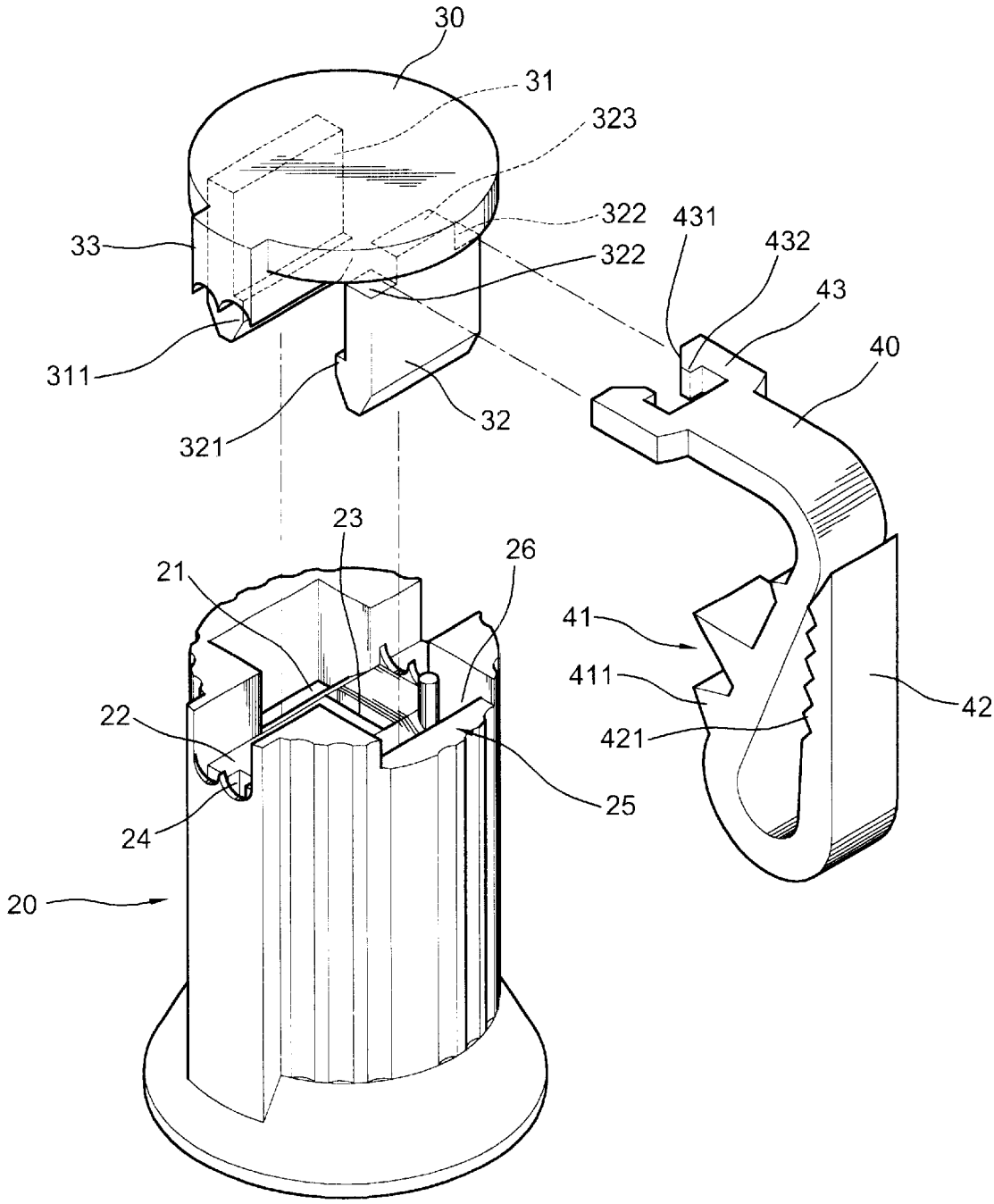
FIG. 4 is an exploded perspective view to show a preferred embodiment of the present invention.
Figure 5:
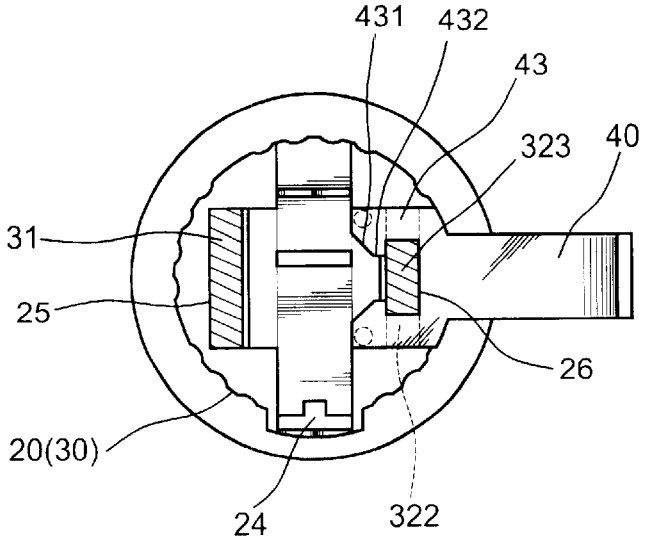
FIG. 5 is a cross-section of FIG. 4.

With reference to FIGS. 4 to 7 of the drawings, the fastening device for a Christmas light according to the present invention comprises generally a socket 20, a cap 30 and a separating fastener 40 which is selectively engaged with the Christmas light.

The socket 20 is a conventional type and has a pair of retaining holes 21 and 26 symmetrically formed in the bottom, a wire slot 22 radially formed across the bottom including a pair recesses 23 and 24 for receiving the tip point from the conduct plates and a notch 25 in a circumferential wall perpendicular to the wire slot 22.

Figure 6:
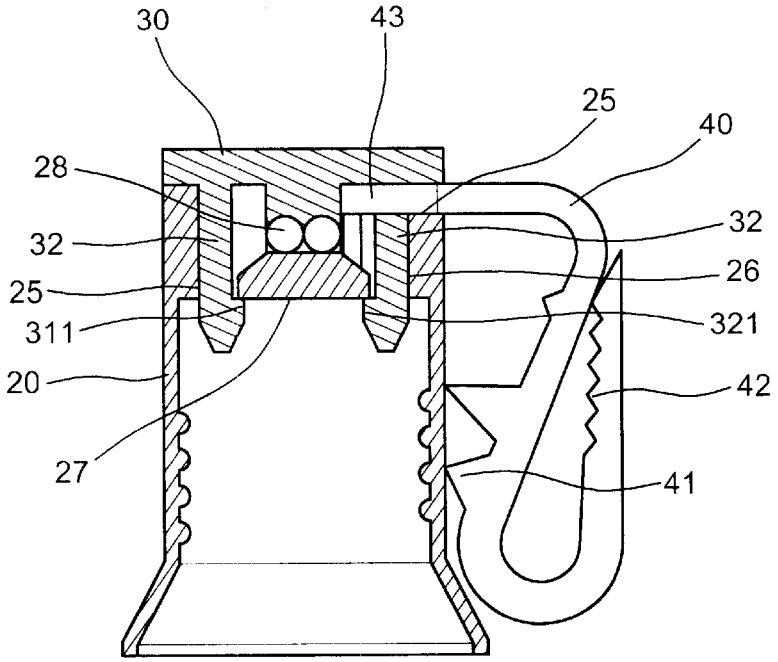
FIG. 6 is a longitudinal-section of FIG. 4.

The cap 30 has a circular body, a pair of first and second projections 31 and 32 symmetrically projected downward from the underside of the body and engageable into the retaining holes 21 and 26 of the socket 20 and each including a barb end 311 and 321 for firmly engaging the cap 30 with the inner surface of the bottom of the socket in a snap fitting (as shown in FIG. 6). The second projection 32 has a pair indentations 322 in the root so as to define a narrow portion 323 therebetween facing to the notch 25 of the socket 20 when the cap is engaged with the socket 20.

The separating fastener 40 has a roughly L-shaped body, a first clip 41 which clips an object between the socket 20 and itself, a second clip 42 extending upward from the lower end of the body and having a bevel upper end engageable with the outer surface of the first clip 41, both the first and second clips 41 and 42 including a serrated portion 411 and 421 on inner surface for firmly clipping an object, a jaw 43 formed at the upper end of the body including a pair of elastic nose 431 each of which has a bevel end 432 engageable into the indentations 322 of the cup 30.

The separating fastener 40 is selectively used by the user. So that it is separately packed with the Christmas light in order to save the space on transportation.

Figure 7:
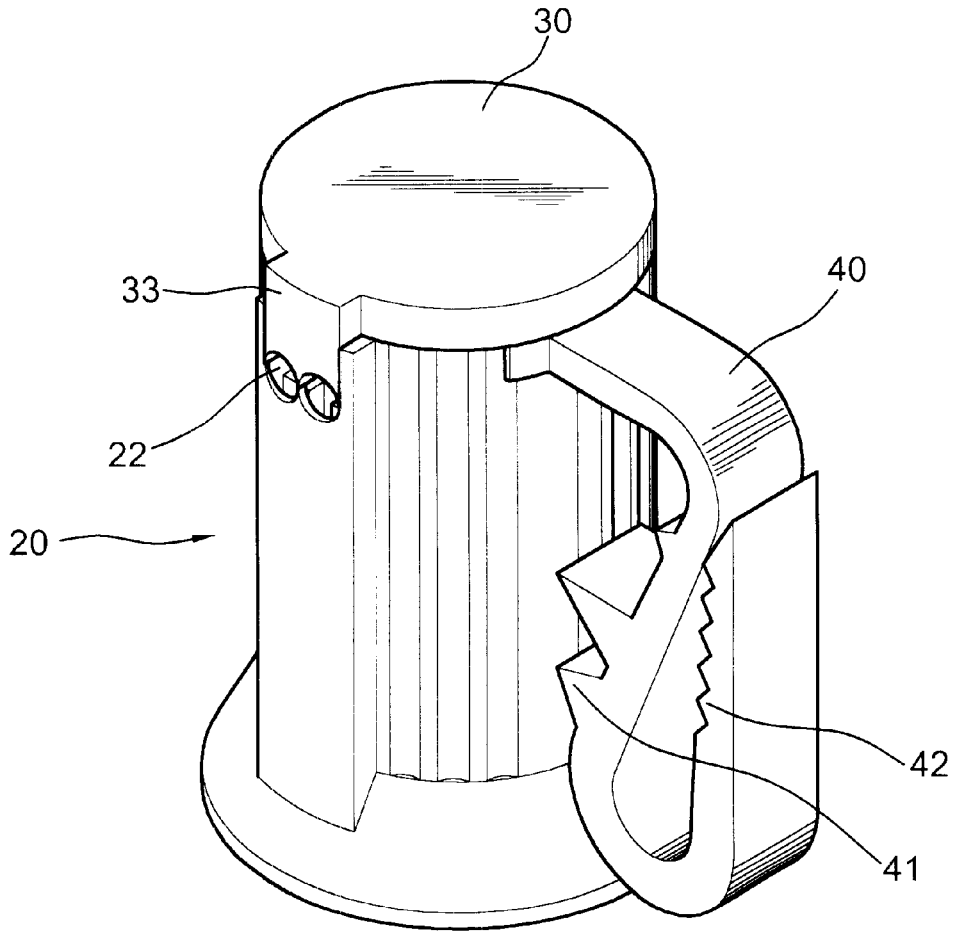
FIG. 7 is a perspective view to show an assembly of FIG. 4.

When it is used, the user engages the noses 431 of the jaw 43 with the indentations 322 of the cap 30 through the notch 25 and presses them in, the bevel end 432 will clip the inner surface of the narrow portion 323 of the second projection 32 in a snap fitting. Once the separating fastener 40 is engaged with the socket 40 it will be difficult to break away. FIG. 7 show a well assembled separating fastener 40 to the socket 20 of a Christmas light.

Both the first and the second clip 41 and 42 are able to clip the Christmas light onto a flat or linear object at high or lower places.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A fastening device for a Christmas light comprising:

a socket having a bottom, a pair of retaining holes symmetrically formed in the bottom, a wire slot radially formed across the bottom including two recesses therein for receiving a pair of tip points for a pair of conductor plates and a notch formed in a circumferential wall of the bottom abutting one of the retaining holes;

a cap having a circular body, a pair of first and second projections symmetrically projecting downward from an underside of the body engaged into the retaining holes of the socket and each including a barb end engaged with an inner surface of the bottom of the socket, said second projection having a pair of indentations symmetrically formed in root thereof defining a narrow portion therebetween facing the notch of the socket;

a separating fastener having a L-shaped body, a jaw member at a first end of the L-shaped for engaging the fastener with the socket including a pair of elastic noses engaged with the indentations of the cap through the notch of the socket, each nose having a bevel end engaged with an inner surface of the narrow portion of the second projection, a first clip defined between the socket and a lower portion of the L-shaped body and a second clip defined by an extension extending upward from a lower end of the first clip having a bevel upper end engageable with an outer surface of the first clip.

2. The fastening device as recited in claim 1 wherein said first and second clips both have serrated portions on their inner surfaces for firmly attaching said Christmas light to a flat and/or linear object.

* * * * *